US005272276A

United States Patent [19]

Okamoto et al.

[11] Patent Number: 5,272,276

[45] Date of Patent: Dec. 21, 1993

[54] ELECTRONIC MUSICAL INSTRUMENT ADAPTED TO SIMULATE A RUBBED STRING INSTRUMENT

[75] Inventors: Tetsuo Okamoto; Satoshi Usa; Itsuro Kubota, all of Hamamatsu, Japan

[73] Assignee: Yamaha Corporation, Hamamatsu, Japan

[21] Appl. No.: 639,980

[22] Filed: Jan. 11, 1991

[30] Foreign Application Priority Data

Jan. 16, 1990 [JP] Japan ..... 2-6655

[51] Int. Cl.[5] ..... G10H 1/02

[52] U.S. Cl. ..... 84/737; 84/626; 84/629

[58] Field of Search ..... 84/600, 603, 626, 625, 84/629, 631, 644, 658, 662, 664, 670, 718, 737, 743, 682, 489.1, 486, 487, DIG. 7

[56] References Cited

U.S. PATENT DOCUMENTS

| | | | |
|---|---|---|---|
| 3,824,354 | 7/1974 | Anderson et al. | 128/23 R |
| 4,257,305 | 3/1981 | Friend et al. | 84/DIG. 7 |
| 4,430,917 | 2/1984 | Pepper, Jr. | 84/DIG. 7 X |
| 4,653,374 | 3/1987 | Iba . | |
| 4,810,992 | 3/1989 | Eventoff | 338/99 |
| 4,868,869 | 9/1989 | Kramer | 84/622 |
| 4,932,304 | 6/1990 | Franzmann | 84/671 |
| 4,961,363 | 10/1990 | Mizano | 84/615 |
| 4,972,496 | 11/1990 | Sklarew | 382/13 |
| 4,984,276 | 1/1991 | Smith . | |
| 4,991,218 | 2/1991 | Kramer | 84/622 X |
| 5,008,497 | 4/1991 | Asher | 178/18 |
| 5,117,730 | 6/1992 | Yamauchi | 84/723 |

*Primary Examiner*—William M. Shoop, Jr.
*Assistant Examiner*—Jeffrey W. Donels
*Attorney, Agent, or Firm*—Graham & James

[57] ABSTRACT

The electronic musical instrument, which is suitable for generating sustaining tone of a rubbed string instrument, has a manipulator for achieving performance manipulation in a linear manipulation region or in a plane manipulation region to simulate the motion of a bow of the rubbed string instrument, and a processing circuit for applying smoothing treatment to signals given by the manipulator. The musical tone generated by the electronic musical instrument can be prevented from being contaminated with discordant sound caused by noise produced in performance manipulation.

13 Claims, 11 Drawing Sheets

ELECTRONIC MUSICAL INSTRUMENT ADAPTED TO SIMULATE A RUBBED STRING INSTRUMENT

BACKGROUND OF THE INVENTION a) Field of the Invention

The present invention generally relates to electronic musical instruments, and more particularly to an electronic musical instrument having a performance manipulator capable of generating control variables which change substantially continuously, such as a variable which represents a position on a line or on a plane.

b) Description of the Related Art

Most of electronic musical instruments employ keyboards as main performance manipulators. A keyboard has a plurality of keys so that information of pitch corresponding to each key is generated when the key is depressed.

Recently, much headway has been made in the development of electronic musical instruments capable of imitatively generating musical tones of a rubbed string instrument, or the like. In a rubbed string instrument, pitch is changed continuously by shifting the position of the finger pressing a string on a fingerboard. Further, the rubbing speed of the bow, i.e. relative speed between the bow and the string (bow speed) and the pressure of the bow which is applied to the string (bow pressure) can be changed continuously, so that the musical tone can be changed expressively correspondingly to the amounts of the continuous changes of these variables.

Also in an electronic musical instrument, use of such control variables that can change continuously is effective for changing the musical tone expressively.

Heretofore, performance manipulators such as a keyboard, a guitar-style controller, a wind-instrument style controller, etc. have been used as real-time performance manipulators for electronic musical instruments. However, the expression of the musical tone in electronic musical instruments using those performance manipulators is more or less inferior to that in natural musical instruments.

Therefore, there has been made an idea that the speed and pressure equivalent to the bow speed and the bow pressure in a natural rubbed string instrument such as a violin are detected by use of a real-time performance manipulator capable of imitating the image of the rubbed string instrument and are inputted as tone generator control parameters.

The assignee of this application has proposed various manipulators of one dimension (linear manipulators) or two or more dimensions (plane or space manipulators) having a pressure sensor. By actuating the proposed manipulators, it is possible to detect the position and pressure at every sampling time interval to thereby generate information pertaining to the speed and pressure.

The information pertaining to the speed, pressure, etc. given by such manipulators capable of generating control variables which can change substantially continuously, contains various kinds of noise. For example, the noise is caused by the variations of the detecting means per se, etc. and by the disturbance, etc. When such signals containing noise are inputted into tone generators, the tone may often become unstable or may often stop.

For example, a non-linear characteristic of a non-linear circuit 18 which is incorporated in tone generator 60 (FIG. 2) is shown in FIG. 15 and behavior of the characteristic is hereunder described.

The non-linear circuit 18 is accompanied with a division circuit 17 provided on the input side, and a multiplication circuit 19 provided on the output side. The division circuit 17 and the multiplication circuit 19 receive the bow pressure signal through the gate 20. That is, a small signal formed by dividing the input by the bow pressure signal is inputted into the non-linear circuit 18, and a large signal formed by multiplying the output by the bow pressure signal is produced in the multiplication circuit 19. Accordingly, when the characteristic of the non-linear circuit 18 is fixed, the scales of the input and output signals of the non-linear circuit 18 change as the bow pressure signal changes. In short, as the bow pressure signal is enlarged, the linear region of the characteristic is widened. This means the fact that the static friction coefficient portion is widened.

When the input signal is small amount, the output signal proportionally increases. Then, the output signal is fed back through LPF 22 to be applied to the input signal is an adder 15. So, the input signal to the non-linear circuit 18 increases by a feed back amount, the output signal responsively increases. In this manner, the output signal gradually increases. Finally, the input signal excesses a certain value, i.e. the input signal reaches the small output region, then the output signal falls into small amount. Therefore, the feed back amount into the adder 15 also falls into small amount. Responsive to this, input signal to the non-linear circuit decreases, i.e., the input signal becomes to get into the linear region.

If bow motion is sustained, the input signal is gradually increases, above-mentioned increase-decrease motion is repeated. As a result, the non-linear characteristic simulates relative motion between a bow and a string.

But, if the input signal rapidly increases, the input signal into the non-linear circuit 18 may directly jump into the small input region from the linear region without gradual increase. Therefore, the above-mentioned motion is not functioned, so precise simulation of the natural musical instrument is not realized.

SUMMARY OF THE INVENTION

An object of the present invention is to provide an electronic musical instrument using a manipulator for generating control variables which can change substantially continuously, by which the generated tone can be changed stably and expressively.

Another object of this invention is to provide an electronic musical instrument using a manipulator for generating control variables which can change substantially continuously, and being excellent in noise reduction.

According to an aspect of the present invention, a performance manipulator for generating a control variable or control variables which can change substantially continuously is used so that a predetermined number of time-series sample values are selected from the values of the control variable generated from the performance manipulator and are subjected to smoothing treatment to thereby reduce noise.

For example, the control variable includes a position (coordinates) variable or a pressure variable.

The smoothing treatment includes operation of excluding the maximum and minimum ones from three or more sample values of the control variable received continuously in time sequence.

When noise is produced on the output of the performance manipulator capable of generating a control variable which can change continuously, the control variable which should change gradually in substance may change unexpectedly widely. If the musical tone is generated on the basis of the unexpectedly widely changed control variable, the musical tone may become unstable or may stop. Therefore, a plurality of sample values of the control variable are picked up and subjected to smoothing treatment, so that the influence of noise can be reduced even when unexpected noise is superimposed on the output signal of the performance manipulator.

For example, in the case where a position (coordinates) variable or a pressure variable is used as the control variable, the control variable is in most cases treated as a voltage signal. In the process of generation and transmission of the voltage signal, the voltage may change suddenly like a spike because of factors such as contact, disturbance, etc. If the signal including such a spike pulse is used directly, the musical tone will become offensive to the ears. Therefore, smoothing treatment is applied to the signal containing noise to thereby prevent the generated musical tone from becoming offensive to the ears.

In the smoothing treatment, the disorder of the unexpectedly changed control variable can be prevented to some degree by the simple operation of excluding the maximum and minimum ones from three or more sample values of the control variable.

BRIEF DESCRIPTION OF THE DRAWINGS

FIGS. 4A and 4B illustrate one mode of detection of velocity information, in which FIG. 4A is a diagram showing velocity versus position of the performance manipulator, and FIG. 4B is a circuit diagram functionally showing a circuit for converting position data into velocity data;

FIGS. 5A and 5B illustrate another mode of detection of velocity information, in which FIG. 5A is a diagram showing detected coordinates versus position of the performance manipulator, and FIG. 5B is a block diagram functionally showing a circuit for converting position data into velocity data;

FIGS. 8A to 8C illustrate a median filter as a smoothing circuit, in which FIGS. 8A and 8B are graphs showing examples of data variation, and FIG. 8C is a block diagram of the median filter;

FIGS. 9A and 9B illustrate an averaging circuit as a smoothing circuit, in which FIG. 9A is a graph showing an example of data variation, and FIG. 9B is a block diagram of the averaging circuit;

Figure 1:
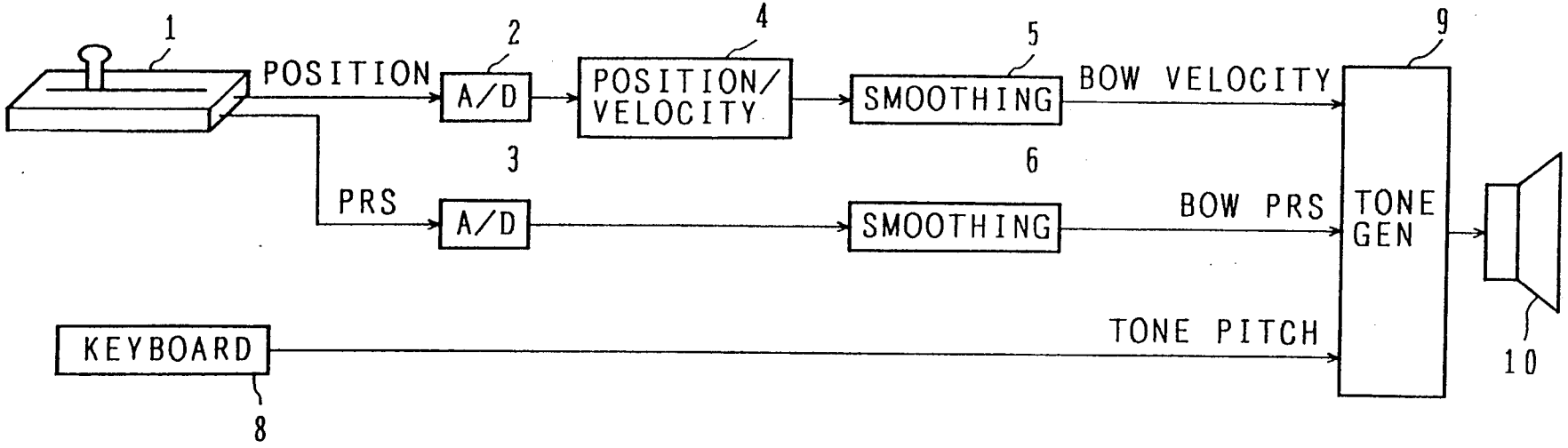
FIG. 1 is a block diagram showing the configuration of an embodiment of the electronic musical instrument according to the present invention.

In the drawings, the reference numerals designate as follows: 1 . . . pressure-sensitive slide-type performance manipulator; 2,3 . . . analog-to-digital conversion circuit; 4 . . . position-to-velocity conversion circuit; 5,6 . . . smoothing circuit; 8 . . . keyboard; 9 . . . tone generator; and 10 . . . sound system.

DESCRIPTION OF THE PREFERRED EMBODIMENTS

FIG. 1 shows an example of the configuration of an embodiment of the electronic musical instrument according to the present invention. An output pertaining to position and another output pertaining to pressure are generated from a pressure-sensitive slide-type performance manipulator 1 and supplied to analog-to-digital conversion circuits (A/D) 2 and 3, respectively. The digital position signal is supplied from the A/D conversion circuit 2 to a position-to-velocity conversion circuit 4. In the position-to-velocity conversion circuit 4, the position signal is converted into velocity information and fed to a smoothing circuit 5. Thus, the smoothed bow velocity information is supplied to a tone generator (TONE GEN) 9. On the other hand, the digital pressure information is fed from the A/D conversion circuit 3 to a smoothing circuit 6. In the smoothing circuit 6, the pressure information is smoothed and supplied as bow pressure information to the tone generator 9. Also, tone pitch information corresponding to the pitch related to a depressed key is generated from a keyboard 8 and supplied to the tone generator 9. The tone generator 9 generates a musical tone forming signal based on the bow velocity information, the bow pressure information and the tone pitch information. The musical tone forming signal is supplied to a sound system 10 so that a musical tone is generated in the sound system 10.

Figure 2:
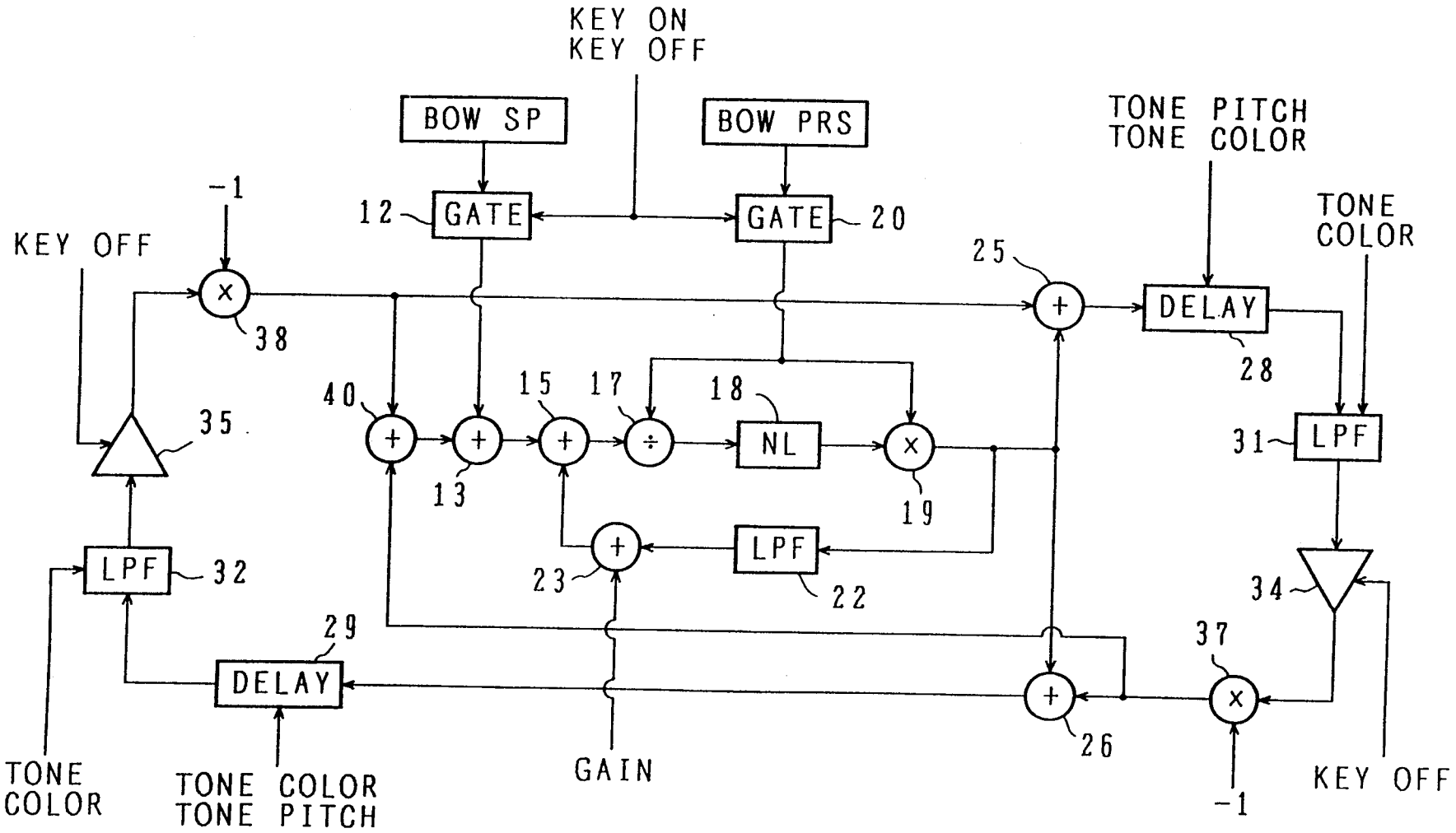
FIG. 2 is a block diagram showing an example of the configuration of the musical tone generating circuit used in the electronic musical instrument depicted in FIG. 1.

FIG. 2 shows an example of a musical tone signal forming circuit as a main part of the tone generator 9 for forming a musical tone signal on the basis of the bow velocity information, the bow pressure information, the tone pitch information, etc. The bow velocity information and the bow pressure information are given through gate circuits 12 and 20, respectively. These gates 12 and 20 are opened (turned on) in response to a key-on signal and are closed (turned off) in response to a key-off signal.

When the bow pressure information is inputted while the gate 12 is opened in response to the key-on signal, the bow velocity information is fed to an addition circuit 13, an addition circuit 15, a division circuit 17 and a non-linear circuit (NL) 18, successively. The non-linear circuit 18 is a circuit for simulating the non-linear characteristic of a string of a rubbed string instrument. In a region in which an input is relatively small, the non-linear circuit 18 generates an output proportional to the input. When the input exceeds a certain value, the non-linear circuit 18 generates a low output which is non-linear with respect to the input. Such a characteristic can approximate the motion of the violin according to the static friction coefficient and the dynamic friction coefficient between the string and the bow. The output of the non-linear circuit 18 is fed to addition circuits 25 and 26 via a multiplication circuit 19.

The addition circuits 25 and 26 are arranged to be symmetric to each other in a circulating path constituting a closed loop. The closed loop approximates the motion of the string of the rubbed string instrument. The closed loop includes a pair of delay circuits 28 and 29, a pair of low-pass filters (LPF) 31 and 32, a pair of decay circuits 34 and 35, and a pair of multiplication circuits 37 and 38. Each of the delay circuits 28 and 29 is a circuit for giving a delay to a signal circulating in the closed loop, to thereby determine the pitch of a generated musical tone. One portion of the string from the string rubbing position where the bow touches the string to the bridge which is a fixed end of the string and the other portion of the string from the string rubbing position to the string pressing position where the finger presses the string onto the fingerboard are approximated by the pair of delay circuits 28 and 29. While vibration is transmitted through the string, the vibration changes according to the characteristic of the string. The low-pass filters serve to approximate the characteristic of the string at the time of transmission of the vibration. Also, while the vibration is transmitted through the string, the vibration decays. The pair of decay circuits 34 and 35 control the amount of decay to simulate the decay of the vibration transmitted through the string. When the key-off signal is inputted, the vibration of the string is stopped by increasing the amount of decay greatly. Also, the vibration of the string is reflected at the fixed end and, at the same time, the phase is inverted. Each of the multiplication circuits 37 and 38 multiplies the input by a fixed coefficient $-1$. That is, the phase is inverted, representing reflection with no decay. In an actual natural musical instrument, decay occurs together with reflection. Therefore, the decay can be considered as the amount of decay in the decay circuits 34 and 35. Further, a tone color signal is supplied to the delay circuits 28 and 29 and the low-pass filters 31 and 32 to thereby adjust the signal waveform. When the input signal circulates in the closed loop as described above, the motion in which the vibration is transmitted through the string, reflected and returned to its original position can be simulated.

Here, the output signals of the multiplication circuits 37 and 38 in FIG. 2 are respectively taken out and inputted into an addition circuit 40. This represents the fact that vibrations propagating from opposite sides of the string are supplied to the string rubbing position. The input signals propagating from opposite directions are added to each other in the addition circuit. The output signal of the addition circuit 40 is supplied to the addition circuit 13, in which the signal is added to the bow velocity signal. This means the fact that a musical tone is generated by adding a vibration generated by newly rubbing the string with the bow to a sustaining tone of the vibratory string while a continuous tone is generated by rubbing the string with the bow.

The non-linear circuit 18 is accompanied with a division circuit 17 provided on the input side, and a multiplication circuit 19 provided on the output side. The division circuit 17 and the multiplication circuit 19 receive the bow pressure signal through the gate 20. That is, a small signal formed by dividing the input by the bow pressure signal is inputted into the non-linear circuit 18, and a large signal formed by multiplying the output by the bow pressure signal is produced in the multiplication circuit 19. Accordingly, when the characteristic of the non-linear circuit 18 is fixed, the scales of the input and output signals of the non-linear circuit 18 change as the bow pressure signal changes. In short, as the bow pressure signal is enlarged, the linear region of the characteristic is widened. This means the fact that the static friction coefficient portion is widened.

The output of the multiplication circuit 19 is fed back to the addition circuit 15 through the low-pass filter 22 and the addition circuit 23. The characteristic of the non-linear circuit 18 has a central linear region which depends on the static friction coefficient, and an outside small output region which depends on the dynamic friction coefficient. The characteristic of the non-linear circuit 18 is changed stepwise between the linear region and the small output region. When the input signal is increased into the region controlled by the dynamic friction coefficient, the output of the non-linear circuit is reduced so that the value fed back to the input side through the feedback loop is reduced. When the input is reduced after once entering the dynamic friction coefficient region, the feedback is small corresponding to the small output. Accordingly, changeover occurs at a smaller input value. That is, in the vicinity of the changeover, there is a difference between the feedback value in the case of increasing the input of the non-linear circuit 18 and the feedback value in the case of decreasing the input. As a result, a characteristic having hysteresis is given as a whole.

The low-pass filter 22 is a circuit for preventing oscillation or the like.

In the musical tone forming circuit as shown in FIG. 2, the bow velocity information and the bow pressure information as well as the tone pitch information are used as important parameters for forming the musical tone. In the configuration of FIG. 1, these parameters are given by the pressure-sensitive slide type performance manipulator 1. When these parameters change suddenly, the generated musical tone changes unexpectedly.

Figure 3:
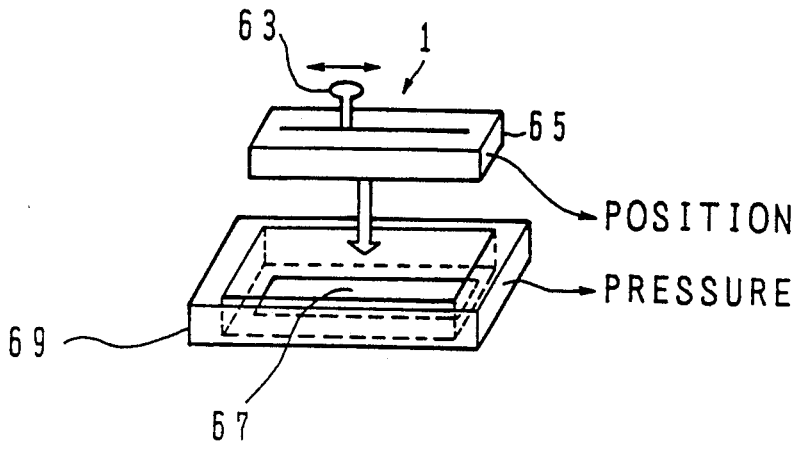
FIG. 3 is a perspective view showing an example of the construction of the pressure-sensitive performance manipulator used in the electronic musical instrument depicted in FIG. 1.

FIG. 3 is a schematic perspective view showing an example of the configuration of the pressure-sensitive performance manipulator.

The pressure-sensitive performance manipulator 1 has a knob 63 which continues to a sliding terminal of a slide volume or a potentiometer at the lower portion of the knob 63. A resistance value corresponding to the position of the knob 63 is detected from a slide resistor 65. The slide resistor 65 including the knob 63 is disposed on a pressure sensor 67, so that the pressure sensor generates a pressure signal corresponding to the force with which the knob 63 is pressed down. Here, the pressure sensor 67 is put in a casing 69.

Each of the position signal and the pressure signal is generated in the form of a voltage signal. For example, a predetermined voltage is applied between the opposite ends of the slide resistor so that a voltage corresponding to the position of the knob 63 is taken out from the sliding terminal. Also, a voltage signal changing correspondingly to the applied pressure is obtained by the pressure sensor 67.

A method of generating velocity information on the basis of the position of a hand manipulator of a performance manipulator constructed as described above will be described hereunder.

Figure 4A:
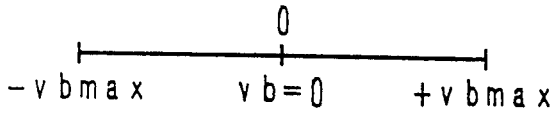
Figure 4B:
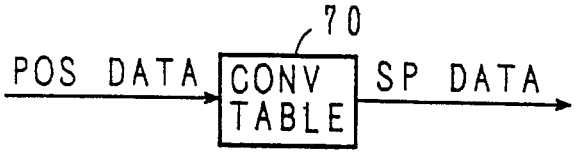

FIGS. 4A and 4B show a mode for generating velocity information directly on the basis of the position of the knob 63.

It is now assumed that the velocity relative to the position of the knob 63 is set within a range of movement of the knob 63 as shown in FIG. 4A. For example, the center position is established to be a position for the velocity $vb=0$, the right-end position is established to be a position for the velocity $vb_{max}$, the left-end position is established to be a position for $-vb_{max}$, and the intermediate positions are established to be positions corresponding to the intermediate velocity.

The aforementioned relation can be realized by a conversion table. That is, a position data is converted into a velocity data on the basis of the conversion table 70 as shown in FIG. 4B. In this case, one velocity value is determined when one position value is determined. When the knob 63 is stopped, a constant velocity data is outputted.

Figure 5A:
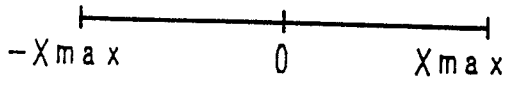
Figure 5B:
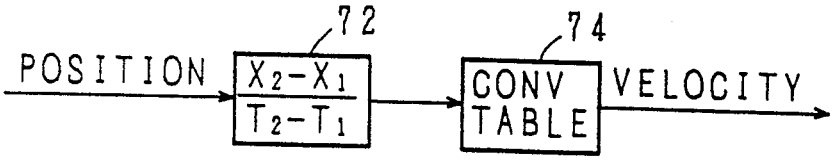

FIG. 5A and 5B show another mode for generating velocity information. In this mode, position information is used directly as position information as shown in FIG. 5A. The distance of movement of the position in a unit time is measured, so that velocity information is calculated by dividing the distance of movement by time. Accordingly, a velocity data can be generated on the basis of the actual velocity, so that the relation between position and velocity can be determined easily by intuition.

In the case where sampling is made periodically on the basis of a timer, the position movement $X_2-X_1$ in a period between adjacent sampling times corresponds to the velocity in the period because the time difference $T_2-T_1$ between adjacent sampling times is constant. That is, as shown in FIG. 5B, position data are supplied to a division circuit 72, in which a signal of the value $(X_2-X_1)/(T_2-T_1)$ is generated and then converted into a velocity data on the basis of the conversion table 74.

When the operation mode as shown in FIGS. 4A and 4B is used, performance manipulation becomes easy for beginners. For example, while the skillful hand is used for tone pitch designation, the other hand can be used for manipulation of the knob 63 of the slide resistor. In this case, the manipulation of the slide resistor is very easy, because the bow velocity can be kept constant by stopping the knob 63 at a certain place. Accordingly, it can be said that this mode is suitable for difficult performance such as quick-tempo performance (fast-moving musical note), tone pitch jumping performance, etc.

In the case of the mode as shown in FIGS. 5A and 5B, the operation of moving the knob 63 resemble so closely the operation of playing the actual rubbed string instrument that this mode is suitable for human feelings, because the operation of moving the knob 63 is proportional to the bow velocity. Accordingly, an optimum operation can be made by intuition in the case where fine expression is required.

As described above, the velocity information detection modes as shown in FIGS. 4A and 4B and FIGS. 5A and 5B have advantages, respectively. Accordingly, it is useful that a changeover switch for changing over between these modes is provided.

Figure 6:
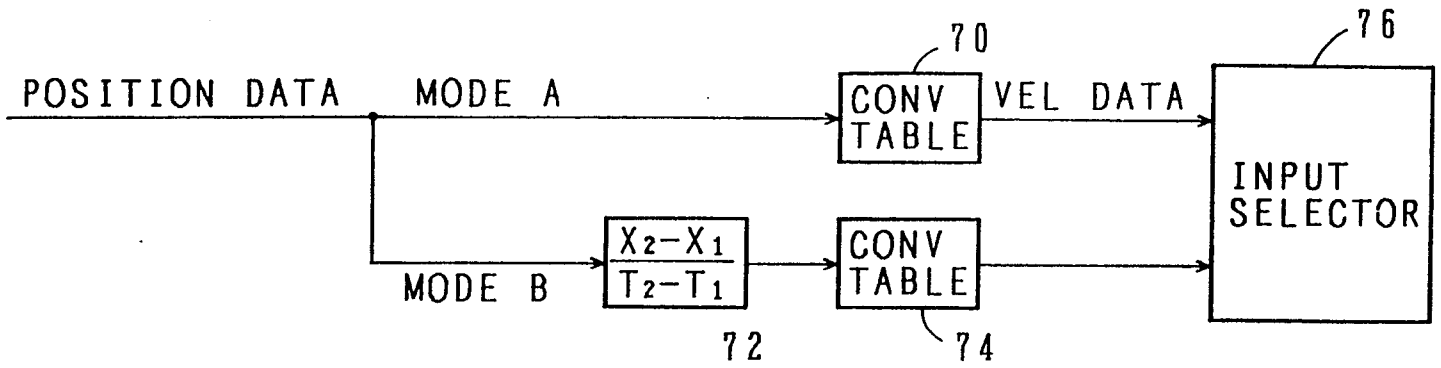
FIG. 6 is a block diagram of a circuit capable of selecting a mode of detection of velocity information.

FIG. 6 shows a system in which the detection of velocity information is made selectively in a mode, which is selected from the mode as shown in FIGS. 4A and 4B and the mode as shown in FIGS. 5A and 5B. In one route A, the position data is supplied to an input selecting means 76 through a conversion table (CONV TBL 2) 70. In the other route B, the position data is supplied to the input selecting means 76 through a division circuit 72 (for dividing the distance of movement of the position by the passed time) and a conversion table (CONV TBL 1) 74.

The input selecting means 76 selects one input and sends out it. That is, the mode A as shown in FIGS. 4A and 4B or the mode B as shown in FIGS. 5A and 5B can be selected by the input selection means 76.

In practical use of the electronic musical instrument, most of signal processings are made by a central processing unit (CPU). That is, various function blocks can be realized by storing a program and data in a storage circuit and processing the data in a CPU.

Figure 7:
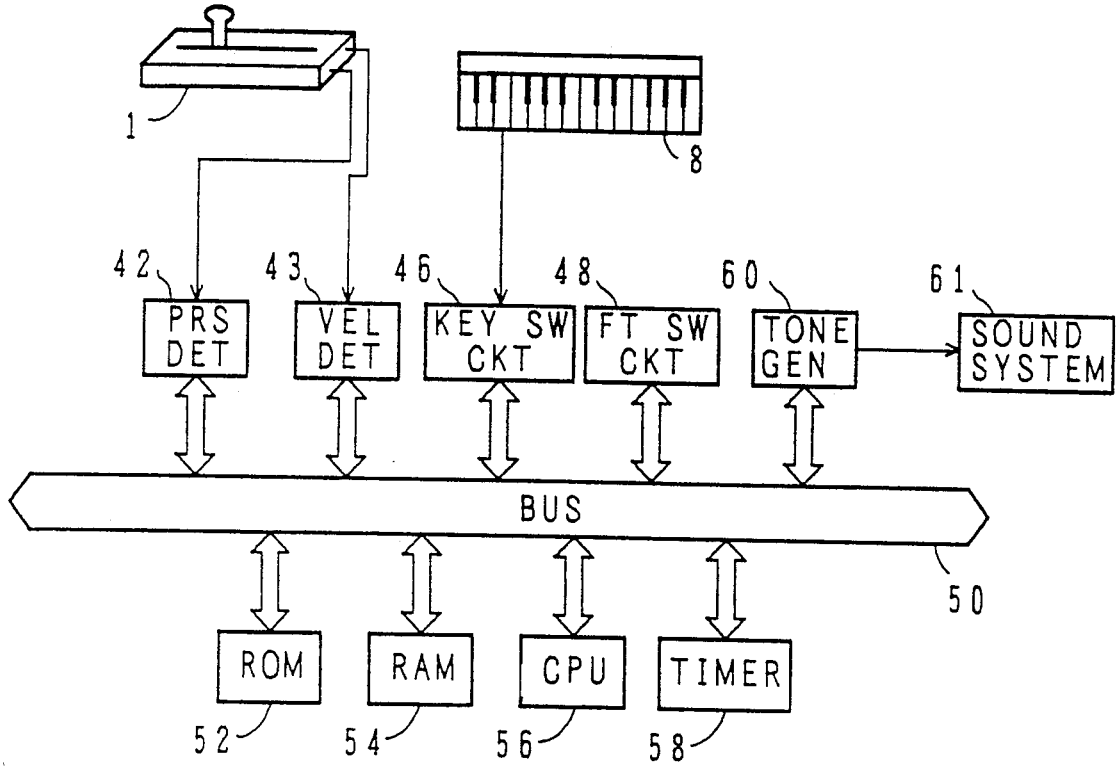
FIG. 7 is a block diagram showing a hardware structure of the electronic musical instrument.

FIG. 7 shows a hardware structure of the electronic musical instrument. The performance manipulator 1 such as a slide resistor or the like generates pressure information, velocity information, etc. and sends out the pressure information and the velocity information to a data bus 50 through a pressure detecting circuit 42 and a velocity detecting circuit 43, respectively. When a selected key in a keyboard 8 is depressed, the associated key data is sent out to the data bus through a key switching circuit 46. Further, a function switching circuit 48, a tone generator 60, an ROM 52, an RAM 54, a CPU 56, a timer 58, etc. are connected to the data bus 50. Also, the output of the tone generator 60 is fed to a sound system 61 for generating the musical tone. Here, the ROM 52 stores an arithmetic operation program to be executed by the CPU 56, and the RAM 54 contains registers, work memories, etc. for storing parameters used in the arithmetic operations.

The smoothing circuits 5 and 6 as shown in FIG. 1 can be realized by the program stored in the RAM 54 and the ROM 52 and the arithmetic operations of the CPU 56. Examples of the smoothing circuit realized by the ROM 52, the RAM 54 and the CPU 56 will be described hereunder.

Figure 8A:
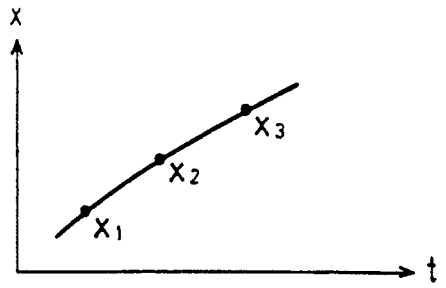
Figure 8B:
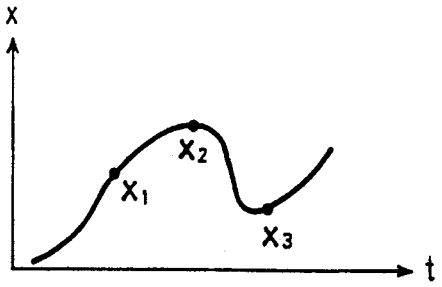
Figure 8C:
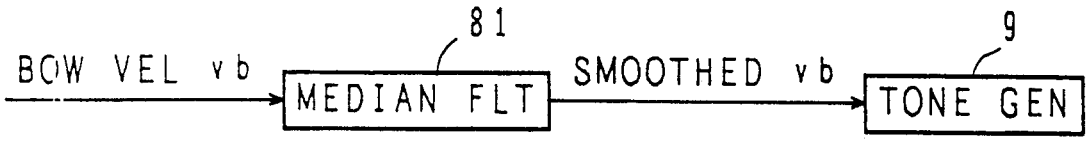

FIGS. 8A, 8B and 8C are views for explaining an example of the smoothing circuit. This smoothing circuit accumulates three sample values detected in time sequence and selects the median value from the three values as an output value. FIG. 8A illustrates the case where the coordinate (ordinate) increases monotonically. It is now assumed that coordinates $X_1$, $X_2$ and $X_3$ are detected with the passage of time and have the relation $X_1<X_2<X_3$. In this case, the median value selected from the three values $X_1$, $X_2$ and $X_3$ is $X_2$. Accordingly, the output value is $X_2$.

FIG. 8B illustrates the case where the value of the coordinate x takes a peak. It is now assumed that coordinates $X_1$, $X_2$ and $X_3$ detected in time sequence have the relation $X_1<X_3>X_2$. In this case, the value $X_2$ detected at the median point in time sequence is not used, because the value is the largest one. Larger one $X_1$ in the values $X_1$ and $X_2$ is supplied as the output value. That is, the relation $X_2<X_1<X_3$ is established, so that the median value $X_1$ is selected as the output value.

FIG. 8C illustrates an example of a circuit for carrying out the aforementioned operation. When bow velocity information vb is supplied to a median filter 81, the median value of velocity is supplied from the median filter 81 to the tone generator 9. Among a plurality of bow velocity data, a bow velocity data smoothed by the median filter 81 is supplied to the tone generator 9.

The smoothing circuit of FIG. 8C is a circuit for selecting the median value among a plurality of sampling values selected in time sequence. In this case, the value at a sampling point exhibiting a rapid change may be neglected.

Figure 9A:
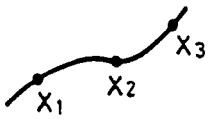
Figure 9B:
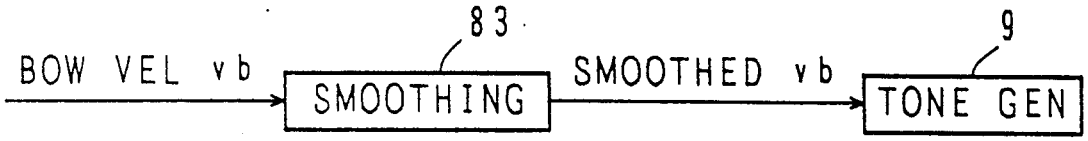

FIGS. 9A and 9B show an example of a smoothing circuit for averaging values given at a plurality of sampling points. It is now assumed that the coordinate x changes to $X_1$, $X_2$ and $X_3$ with the passage of time as shown in FIG. 9A.

As shown in FIG. 9B, the smoothing circuit has an averaging circuit 83 which receives bow velocity information vb and sends out a smoothed output to the tone generator 9. When, for example, bow velocity values $X_1$, $X_2$ and $X_3$ are given as shown in FIG. 9A, the averaging circuit 83 carries out the arithmetic operation of $(X_1+X_2+X_3)/3$.

The smoothing treatment as described above can be realized by storing the input signal in the RAM 54 and carrying out a predetermined arithmetic operation in the CPU 56 according to the program stored in the ROM.

Now, registers provided in the RAM 54 will be explained hereinbelow.

Mode Register (MD)

This is a register for selecting a mode of detection of velocity information. The mode is selected from a mode in which the position detected by the performance manipulator is directly converted into velocity (MODE A) if MD=0, and a mode in which the distance of movement detected in a predetermined period is converted into velocity (MODE B) if MD=1.

Pressure Register (P(n))

This is a register for storing pressure detected by the performance manipulator. Pressure data detected in time sequence are stored in registers P(1), P(2) and P(3), respectively.

Present Position Register (POS)

This is a register for storing a position currently detected by the performance manipulator.

Previous X Position Register (X)

This is a register for storing the position previously detected by the performance manipulator.

Difference Register (DIF)

This is a register for storing the difference (the distance of movement) between the present position and the previous position.

Velocity Register (V(n))

This is a register for storing velocity. Velocity data detected in time sequence are stored in registers V(0), V(1) and V(2), respectively.

Pressure Register (PRS)

This is a register for storing a smoothed pressure data.

Velocity Register (VEL)

This is a register for storing a smoothed velocity data.

Sampling Number (m) and Circulating Number (n)

These are registers for storing a numeric data m representing the number of samples and for storing a numeric data n representing the number of circulations. The circulating number n changes according to the predetermined modulo number. When, for example, the modulo number is 3, the number n circulates to 1, 2, 0, . . . as the number m increases successively to 1, 2, 3, 4, 5, and 6.

Key Code (KCD)

This is a register for storing information representing a depressed key in the keyboard and the associated tone pitch. The information has a most significant bit (MSB) representing information pertaining to key depression and key release, and other bits representing information pertaining to tone pitch.

The description of other registers is omitted here.

Figure 10:
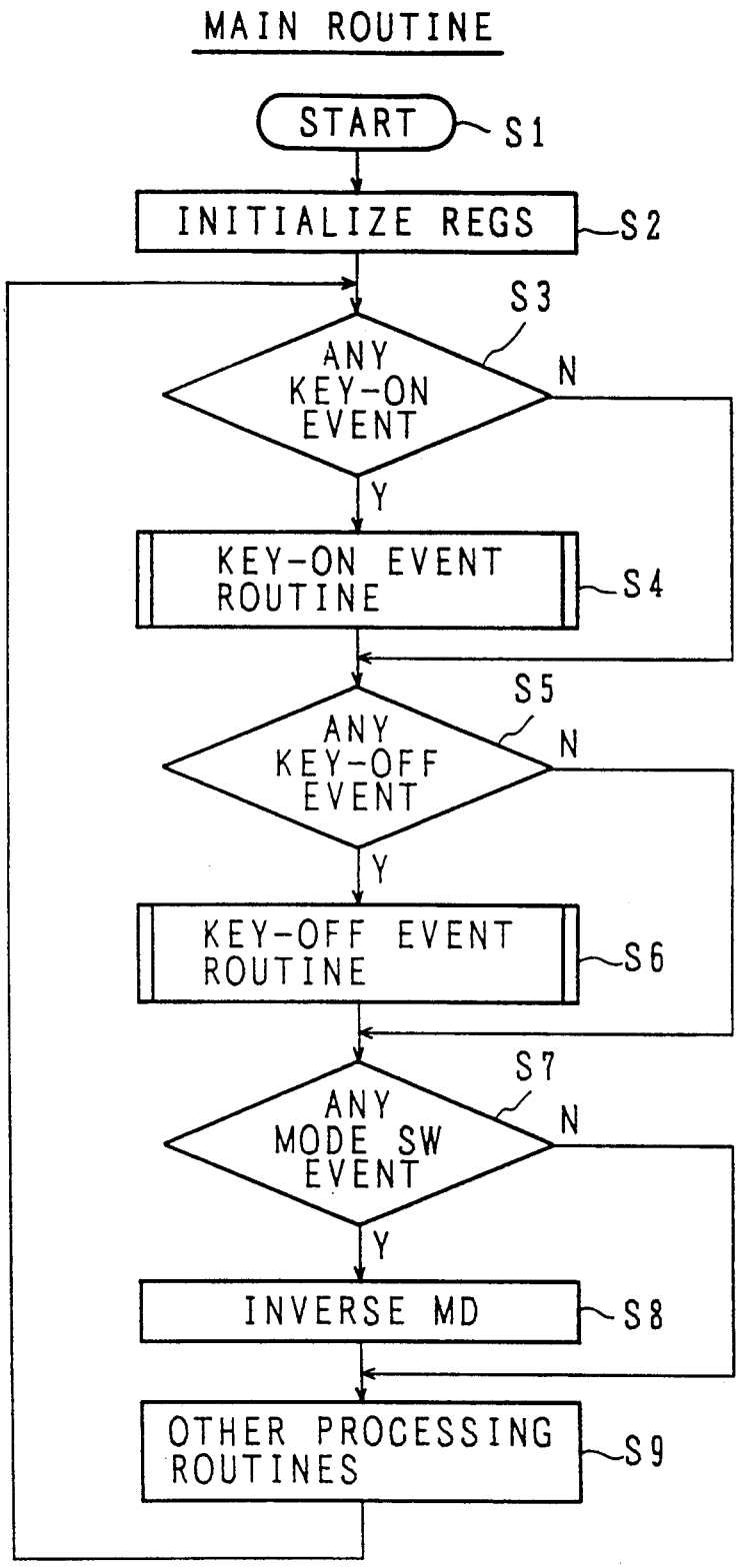
FIG. 10 is a flow chart of the main routine.

In the following, a flow chart of the main routine is explained with reference to FIG. 10. When the main routine is started at the step S1, initialization is done in the next step S2. Then, in the step S3, a judgment is made as to whether there is a key-on event or not. When there is a key-on event, the flow goes to the step S4 to carry out the key-on event routine. When there is no key-on event, the flow skips over the step S4.

Then, in the step S5, a judgment is made as to whether there is a key-off event or not. When there is a key-off event, the flow goes to the step S6 to carry out the key-off event routine. When there is no key-off event, the flow skips over the step S6.

Then, in the step S7, a judgment is made as to whether there is a mode switch event or not. It is now assumed that two modes are used for detection of velocity. When there is a mode switch event, the flow goes to the step S8 to invert the contents of the register MD. When there is no mode switch event, the flow skips over the step S8.

Then, in the step S9, other processing routines are carried out. Then, the flow returns to the step S3.

Figure 11:
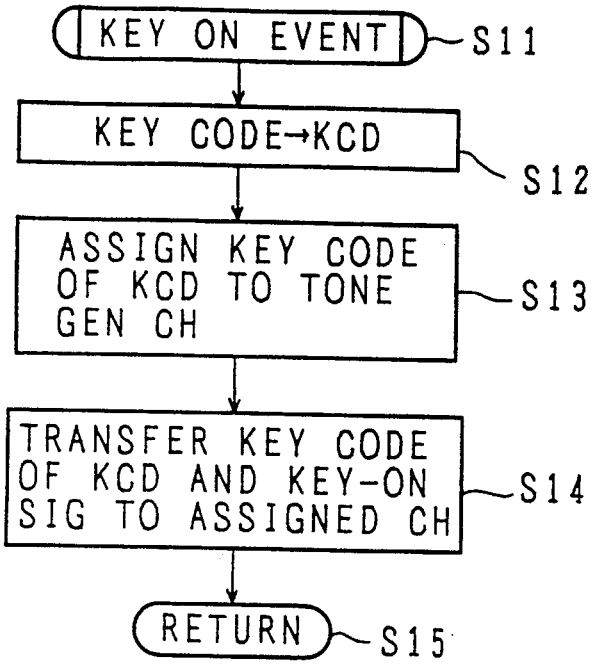
FIG. 11 is a flow chart of the key-on event routine.

In the following, the key-on event which has occurred in the main routine is explained with reference to FIG. 11. When the key-on event is started at the step S11, the key code is stored in the register KCD in the step S12.

Then, in the step S13, the key code stored in the register KCD is assigned to a tone channel of the tone generator.

Then, in the step S14, the key code in the register KCD and a key-on signal are transferred to the designated channel of the tone generator. Then, in the step S15, the flow returns.

Figure 12:
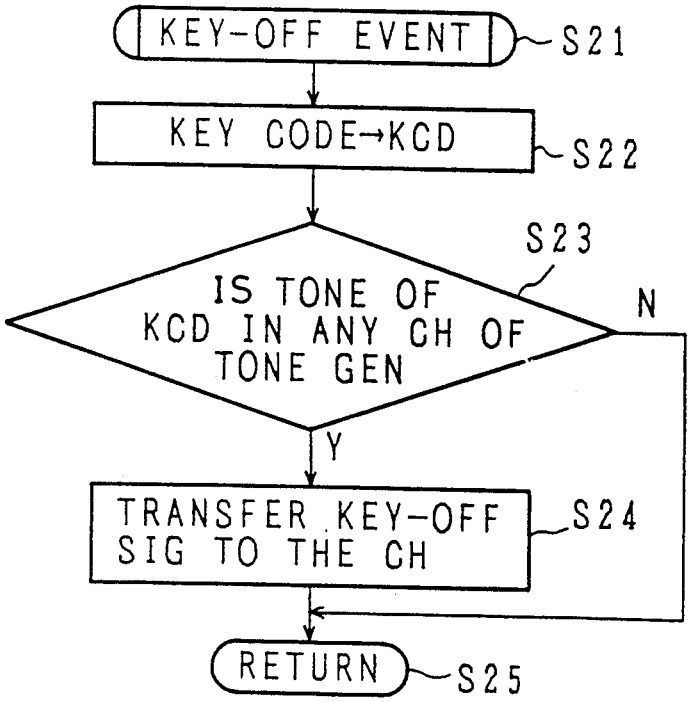
FIG. 12 is a flow chart of the key-off event routine.

In the following, the key-off event which has occurred in the main routine is explained with reference to FIG. 12.

When the key-off event is started at the step S21, the key code is stored in the register KCD in the step S22. To erase the musical tone corresponding to the key in which the key-off event has occurred, in the step S23, a judgment is made as to whether or not there is a tone channel assigned by the key code KCD in which the key-off event has occurred. When there is a tone channel, the flow goes to the step S24 to transfer the key-off signal to the assigned channel of the tone generator to thereby stop tone generation. When there is no tone channel, the flow skips over the step S24 and returns (in the step S25) because tone erasing treatment has been done already.

In the following, a flow chart of the timer interrupt is explained with reference to FIG. 13.

When the timer interrupt is started at the step S31, the detected pressure and the coordinate of the detected position are respectively stored in the registers P(n) and POS in the step S32.

Then, in the step S33, a judgment is made as to whether there is a key-on channel or not. When there is a key-on channel, a judgment is made in the step S34 as to whether the detected pressure P(n) is larger than 0 or not. In the case of $P(n)>0$, the performance manipulator is operated and the flow goes to the step S35 to make a judgment as to whether the mode MD is "1" or not. When the mode MD is "1", the flow goes to the step S36 to make a judgment as to whether the number m is positive or not, because mode B has been selected as the mode of detection of velocity information. The initial values of the number m and the circulating number n are both "0". When m is 0, the flow goes to the step S56 to store the coordinate POS of the position in the previous position register X and the flow returns (the step S57), because $m=0$ represents the fact that a phenomenon is detected for the first time.

When the number m is positive, the value POS-X obtained by subtracting the previous position X from the present position POS is stored in the difference register DIF (Step S37) because $m>0$ represents the fact that the phenomenon has been detected already.

In the next step S38, the result obtained by converting the moving distance DIF into velocity on the basis of a conversion table is stored in the velocity register V(n). Then, in the step S39, the data representing the previous position is updated.

When the mode MD is "0", representing the mode in which the position data is directly converted into a velocity data, the position data POS is converted into a velocity data on the basis of another conversion table and then the velocity data is stored in the velocity register V(n) (Step S54).

After the velocity data is obtained as described above, the flow goes to the step S40 to make a judgment as to whether the number m is larger than 1 or not. When m is larger than 1, the flow goes to the next step S41 to carry out the smoothing routine. When the smoothing routine is finished, the values of the pressure register PRS and the velocity register VEL are transferred to the tone generator in the step S42.

Then, in the step S43, the number m is increased by one. Further, the circulating number n in three modules (the modulo number is 3) is updated.

When the result of the judgment in the step S40 is $m=0$, the flow skips over directly to the step S43 and then returns (the step S44).

Figure 13:
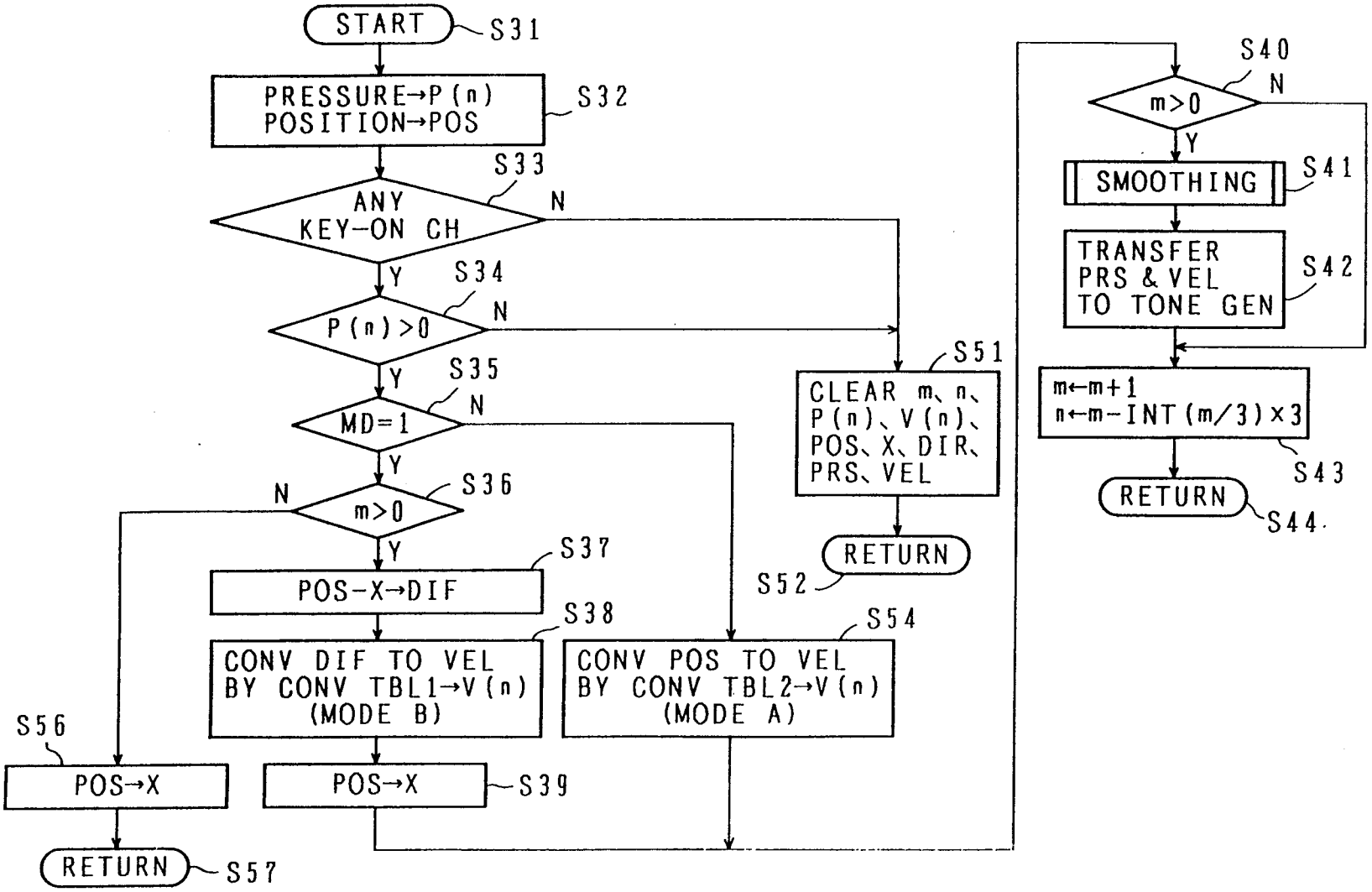
FIG. 13 is a flow chart of the timer interrupt routine.

In the following, the smoothing routine in the step S41 in the flow chart of FIG. 13 is explained with reference to FIG. 14.

When the smoothing routine is started at the step S60, the median value is selected from the pressure registers P(0) to P(2) and stored in the pressure register PRS in the step S61. Further, in the next step S62, the median value is selected from the velocity registers V(0) to V(2) and stored in the velocity register VEL. The operation of selecting a median data from the three data forms a median filter. Here, the step S61 and the step S62 may be exchanged with each other. Then, the flow goes to the step S63 and returns.

Figure 14:
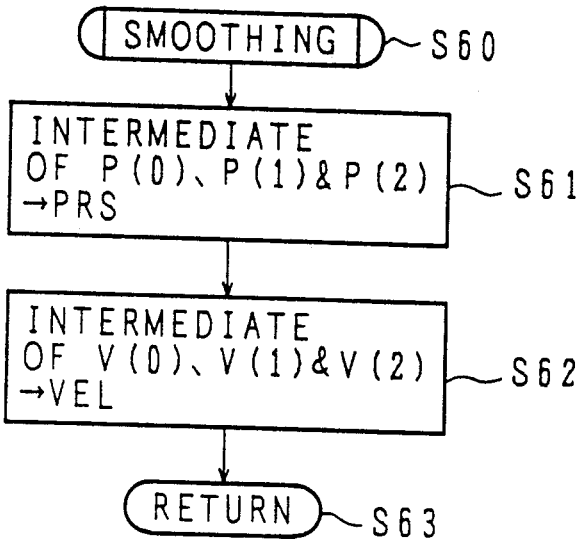
FIG. 14 is a flow chart of the smoothing routine.
Figure 15:
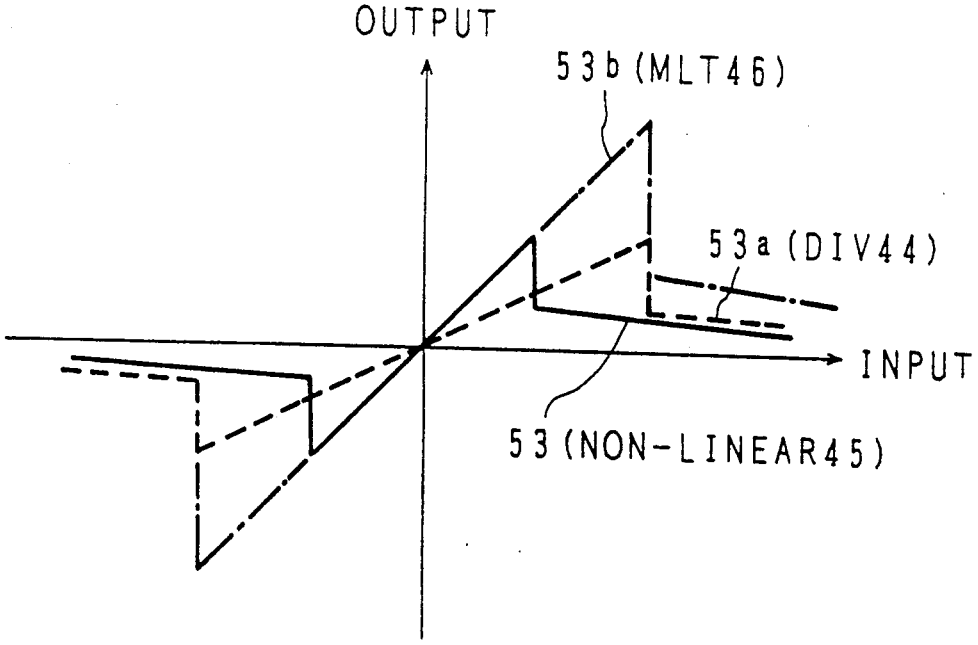
FIG. 15 is a graph showing the functions of the division circuit 54 and the multiplication circuit 56 for altering the characteristics of the non-linear circuit 55.

That is, a median value is selected from three continuous values by the smoothing treatment of FIG. 14. The values thus selected are newly used as pressure data PRS and velocity data VEL.

The output signals (representing the position and the pressure) of the pressure-sensitive slide type performance manipulator as shown in FIG. 1 may change suddenly. The sudden changes of the output signals may be caused by the manipulator itself or may be caused by factors such as disturbance, etc. If the sudden changes of the output signals are directly inputted into the musical tone forming circuit, the generated musical tone will become offensive to the ears.

Therefore, smoothing treatment is carried out in the aforementioned embodiment according to this invention. Accordingly, even if parameters such as position, pressure, etc. change suddenly, the sudden changes of the parameters are relaxed so that unpleasant influence on the generated musical tone can be reduced.

Although description has been made upon the case where a smoothing circuit for selecting a median value from three values taken at three points continuous in time sequence is used, the invention is not limited to the specific embodiment. For example, another smoothing circuit for calculating a newest value by averaging three intermediate values obtained after excluding a maximum value and a minimum value from five values continuous in time sequence may be used. In short, it will be apparent to those skilled in the art that various types of smoothing circuits may be used in this invention.

Although description has been made upon the case where a slide type performance manipulator is used, any type manipulator such as a tablet type plane manipulator, a three-dimension type manipulator, etc. may be used. The position in two or more dimensions may be decomposed into a plurality of one dimensional data. Then, each one-dimensional data may be smoothed. Alternatively, a variable such as distance from a reference point or between adjacent sampling points may be smoothed.

Although description has been made upon the case where a physics tone generator is used as a tone generator, any other tone generator such as an FM tone generator, a waveform memory, or the like, may be used. The tone generator used in this invention may be of the monotone type or may be of the multitone type.

Although description has been made upon the case where the parameters subjected to smoothing treatment are position, velocity and pressure, other musical sound control parameters may be smoothed.

As is described above, according to the embodiments of the present invention, sudden changes of a certain continuously changeable control variable given by the performance manipulator are relaxed by smoothing treatment in the case where the control variable changes suddenly. Accordingly, the generated musical tone is prevented from being contaminated with an unpleasant tone offensive to the ears.

Although description has been made on the embodiments of the present invention, the present invention is not limited thereto. For example, it will be apparent for those skilled in the art that various changes, substitutions, modifications, improvements and combinations thereof may be made.

What is claimed is:

1. An electronic musical instrument for generating musical tones comprising:

a performance manipulator for generating a control variable which can be substantially continuously changed;

smoothed signal generating means connected to said performance manipulator, for receiving sampled values of said control variable successively in time sequence, for carrying out smoothing treatment on the received sampled values of said control variable, and for sending out the smoothed signals;

a musical tone signal forming circuit means for receiving said smoothed signals and for forming a musical tone signal by utilizing said smoothed signals as musical tone control parameters, said tone signal forming circuit means including a nonlinear circuit for generating a signal having a nonlinear characteristic, and a closed loop circuit for circulating the signal outputted from said nonlinear circuit, said closed loop circuit including delay means for delaying the signal by a predetermined delay length which determines pitch of the musical tone, a circulating path for circulating the signal, and signal control means for connecting said nonlinear circuit with said closed loop circuit and for receiving said smoothed signals.

2. An electronic musical instrument according to claim 1, in which said control variable includes at least one of position variable and pressure variable.

3. An electronic musical instrument comprising:

a performance manipulator for generating a control variable which can be substantially continuously changed;

smoothed signal generating means connected to said performance manipulator, for receiving sampled values of said control variable successively in time sequence, for carrying out smoothing treatment on the received sampled values of said control variable, and for sending out the smoothed signals, said smoothing treatment includes operation for excluding the maximum and minimum ones of three or more sample values of said control variable received successively in time sequence; and a musical tone signal forming circuit for receiving said smoothed signals and for forming a musical tone signal by utilizing said smoothed signals as musical tone control parameters.

4. An electronic musical instrument according to claim 1, wherein said performance manipulator has a linearly movable manipulator.

5. An electronic musical instrument according to claim 1, wherein said smoothed signal generating means includes a conversion means for converting position information into velocity information.

6. An electronic musical instrument according to claim 5, wherein said conversion means comprises a conversion table.

7. An electronic musical instrument according to claim 5, wherein said conversion means comprises dividing means for dividing a distance by time.

8. An electronic musical instrument according to claim 1, wherein said smoothed signal generating means includes an average means for taking an average value from a plurality of input data.

9. An electronic musical instrument comprising:

a performance manipulator for generating a control variable which can be substantially continuously changed;

smoothed signal generating means connected to said performance manipulator, for receiving sampled values of said control variable successively in time sequence, for carrying out smoothing treatment on the received sampled values of said control variable, and for sending out the smoothed signals, said smoothed signal generating means, includes an averaging means for taking an average value from a plurality of input date and means for excluding a largest and a smallest input data from a plurality of successive input data; and a musical tone signal forming circuit for receiving said smoothed signals and for forming a musical tone signal by utilizing said smoothed signals as musical tone control parameters.

10. An electronic musical instrument according to claim 1, wherein said electronic musical instrument is capable of generating musical tones resembling those of a rubbed string instrument.

11. An electronic musical instrument according to claim 10, wherein said closed loop circuit for circulating a signal provides an output which represents a vibration propagating on a string.

12. An electronic musical instrument according to claim 11, wherein said non-linear circuit provides an output which represents the characteristics of a string rubbed by a bow.

13. An electronic musical instrument according to claim 1, wherein said signal control means modifies characteristics of said nonlinear circuit.

* * * * *